US008196920B2

(12) United States Patent
Deas

(10) Patent No.: US 8,196,920 B2
(45) Date of Patent: Jun. 12, 2012

(54) MEDIA CASSETTE

(75) Inventor: Scott H. Deas, Dundee (GB)

(73) Assignee: NCR Corporation, Duluth, GA (US)

( * ) Notice: Subject to any disclaimer, the term of this patent is extended or adjusted under 35 U.S.C. 154(b) by 294 days.

(21) Appl. No.: 12/338,262

(22) Filed: Dec. 18, 2008

(65) Prior Publication Data

US 2010/0156034 A1 Jun. 24, 2010

(51) Int. Cl.
*B65H 1/08* (2006.01)
*B65H 1/02* (2006.01)

(52) U.S. Cl. ..... 271/147; 271/160; 271/145; 271/162; 271/149

(58) Field of Classification Search ..... 271/147, 271/160, 145, 162, 149
See application file for complete search history.

(56) References Cited

U.S. PATENT DOCUMENTS 4,275,667 A 6/1981 Hilton
4,280,692 A * 7/1981 Hutchinson et al. ..... 271/160
4,593,895 A * 6/1986 Myers et al. ..... 271/148
4,659,008 A * 4/1987 Howett et al. ..... 232/43.3
4,798,316 A * 1/1989 Martin et al. ..... 232/43.1
6,068,439 A * 5/2000 Ohta ..... 414/411
7,028,889 B2 * 4/2006 Jun ..... 235/379
7,850,164 B2 * 12/2010 Ahn et al. ..... 271/162

FOREIGN PATENT DOCUMENTS

JP 55098036 A * 7/1980
JP 59207336 A * 11/1984
JP 03279128 A * 12/1991

* cited by examiner

*Primary Examiner* — Michael McCullough
*Assistant Examiner* — Luis A Gonzalez
(74) *Attorney, Agent, or Firm* — Paul W. Martin

(57) ABSTRACT

A media cassette comprises a housing defining a closeable pick window; an urging plate biased towards the pick window for urging a stack of media items towards the pick window; a detent located distal from the pick window for limiting movement of the urging plate when the pick window is closed; and a detent moving mechanism operable to move the detent when the pick window is opened. The media cassette allows the urging plate to exert less force on the stack of media items by expanding the space available for media items located within the cassette by activating the detent moving mechanism.

12 Claims, 3 Drawing Sheets

FIG. 1
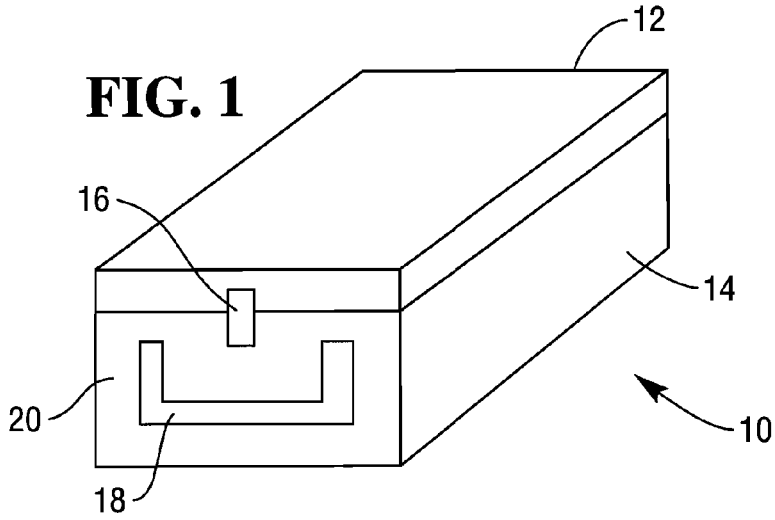
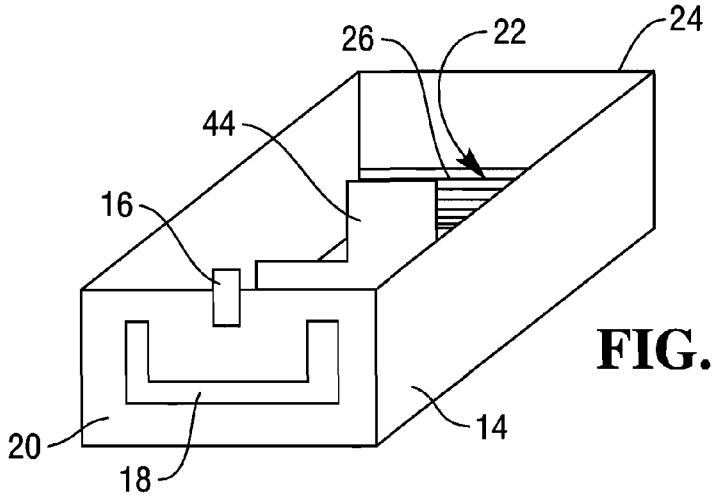
FIG. 2
FIG. 3
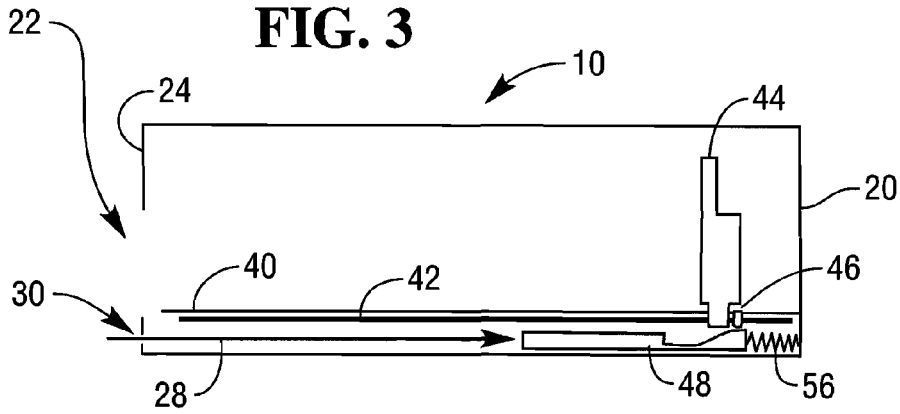

MEDIA CASSETTE

FIELD OF INVENTION

The present invention relates to a media cassette.

BACKGROUND OF INVENTION

Media cassettes are used to store media in sheet form for automated picking and dispensing in a self-service terminal (SST). One particular type of media cassette is a currency cassette, which is used in an automated teller machine (ATM). Currency cassettes are sometimes overfilled by bullion centre or cash-in-transit personnel or machines. When a currency cassette is overfilled then an ATM in which the cassette is installed may not be able to pick banknotes reliably from that cassette because of excessive pressure on the banknote nearest a pick window. This can cause the ATM to go out of service, which results in increased cost and poorer performance for the ATM.

SUMMARY OF INVENTION

Accordingly, the invention generally provides methods, systems, and apparatus for an improved media cassette.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects of the invention may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media cassette comprising a housing defining a closeable pick window; an urging plate biased towards the pick window for urging a stack of media items towards the pick window; a detent located distal from the pick window for limiting movement of the urging plate when the pick window is closed; and a detent moving mechanism operable to move the detent when the pick window is opened, thereby allowing the urging plate to exert less force on the stack of media items.

The urging plate may be slideably mounted on a floor spaced from a lower side of the housing, and coupled to a central rail located beneath the floor. The urging plate may be coupled to a spring that biases the urging plate towards the pick window. The floor, a pick window end of the cassette, and the urging plate may cooperate to define a media zone in which a stack of media items are placed. The media zone may be a currency zone, and the media items may be banknotes resting on their respective long edges, that is, the stack may be a horizontal stack rather than a vertical stack.

The detent may be implemented by a member protruding above the floor and moveable from a first position to a second position. Alternatively, the detent may be implemented by a member located beneath the floor for engaging a lower part of the urging plate, and moveable from a first position to a second position.

The member protruding above the floor may be implemented by a resiliently-biased stub protruding through a detent aperture in the floor, with the bias acting to push the stub towards the lower side of the housing. In this arrangement, the first and second positions are located in vertical alignment (that is, vertical movement of the member shifts the member between the first and the second positions).

The detent moving mechanism may be implemented by a cam member resiliently coupled to an end of the housing, and including a cam surface. The cam member may be moveable from an inactive position to an active position. When in the inactive position, the cam surface causes the resiliently-biased stub to protrude through the detent aperture and above the floor (the first position), thereby stopping the urging plate from moving beyond the detent to an end opposite the pick window (the "non-picking end"). In contrast, when in the active position, the cam surface allows the resiliently-biased stub to extend beneath the floor (the second position), thereby allowing the urging plate to move beyond the location of the detent towards the non-picking end.

The cam member may be moved from the inactive position to the active position by tines located within the ATM and provided to open the pick window as the cassette is mounted in the ATM.

Alternatively, the member protruding above the floor may be implemented by a block slideably moveable parallel to the central rail, so that both the first and second positions are located in a plane parallel to the central rail, but the second position is closer to the non-picking end than the first position. In this arrangement the first and second positions are located in horizontal alignment (that is, horizontal movement of the block shifts the block between the first and the second positions).

The detent moving mechanism may be implemented in a plurality of different ways. For example, tines located within the ATM and provided to open the pick window as the cassette is mounted in the ATM may be used to move the block from the first position to the second position. As another example, a solenoid may be provided to drive the block from the first position to the second position when the cassette is inserted into the ATM, and to drive the block back to the first position when the block is removed from the ATM. The power supply for the solenoid may be internal to the cassette (for example, a battery) or received externally, for example, from the ATM.

Other detent moving mechanisms for moving the detent from the first position to the second position are possible, for example, using rotary, arcuate, or elliptical movement to move the detent.

By virtue of this aspect, when a media cassette is loaded into a self-service terminal, the pick window is opened, and the urging plate is allowed to move backwards relative to the pick window, thereby enlarging the media zone and ensuring that excessive force is not applied to the media items, even if the cassette has been overfilled.

According to a second aspect there is provided a method of presenting media within a media cassette having a pick window defined by one end of the cassette and a non-picking end opposite the pick window, the method comprising: urging a stack of media items towards the pick window; moving a detent from (i) a first position when the pick window is closed, the first position limiting movement of an urging plate, to (ii) a second position when the window is opened, the second position allowing the urging plate to move further from the pick window than when the detent is in the first position; thereby allowing more space for the media between the pick window and the urging plate.

The step of moving a detent from a first position to a second position may comprise moving the detent vertically.

Alternatively, or additionally, the step of moving a detent from a first position to a second position may comprise moving the detent horizontally.

According to a third aspect there is provided a self-service terminal comprising a dispenser including a pick unit engaged with a media cassette of the first aspect.

The pick unit may include a plurality of tines for engaging with the media cassette to open the pick window and to move the detent from the first position to the second position.

The self-service terminal may be an automated teller machine (ATM), an information kiosk, a financial services centre, a bill payment kiosk, a lottery kiosk, a postal services machine, a check-in and/or check-out terminal such as those used in the retail, hotel, car rental, gaming, healthcare, and airline industries, and the like.

These and other aspects will be apparent from the following specific description, given by way of example, with reference to the accompanying drawings.

BRIEF DESCRIPTION OF THE DRAWINGS

FIG. 1 is a schematic perspective diagram of a media cassette in the form of a currency cassette according to one embodiment of the present invention;

FIG. 2 is a schematic diagram of a body portion of the currency cassette of FIG. 1 shown with a lid removed;

FIG. 3 is a simplified sectional side view of the body portion of the cassette of FIG. 1 illustrating a detent mechanism;

DETAILED DESCRIPTION

Figure 4A:
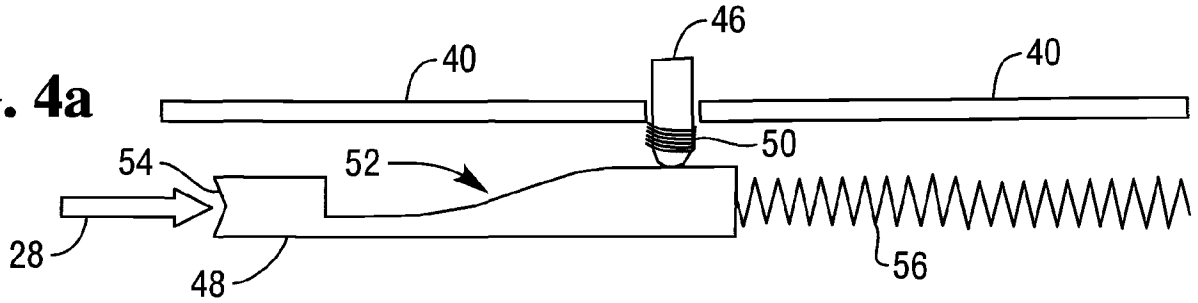
FIGS. 4*a* to 4*c* are simplified side views showing the detent mechanism of FIG. 3 in more detail.

Reference is first made to FIGS. 1 to 3, which illustrate a media cassette 10 in the form of a polycarbonate currency cassette for storing banknotes. The cassette 10 has a lid 12 secured to a body 14 by a latch 16. The body 14 has a handle 18 at a handle end 20 (a "non-picking end"), and a closed pick window 22 at the opposite end 24 (a "picking end").

The picking end 24 includes a roller shutter 26 covering the pick window 22 when the currency cassette 10 is being transported. As is known in the art, when a currency cassette is inserted into a currency dispenser 58 in an ATM 70 (FIG. 5), tines 28 in the currency dispenser engage with blocks (not shown) mounted in channels 30 defined by the body 14 to raise the roller shutter 26 and open the pick window 22.

The cassette 10 includes a floor 40, beneath which a central rail 42 is provided that extends longitudinally along the cassette 10 from the non-picking end 20 to the picking end 24. A biased urging plate 44 is mounted on the central rail 42 and coupled thereto by a ratchet mechanism (not shown). The urging plate 44 urges a stack of banknotes towards the pick window 22, so that when the pick window 22 is open, banknotes can be picked through the pick window 22 by the currency dispenser.

The features described up to this point are known from conventional currency cassettes. In addition to these known features, a detent 46 is located distal from the pick window 22 for limiting movement of the urging plate 44 when the pick window 22 is closed. A detent moving mechanism 48 is located within one of the channels 30 and is operative to move the detent 46 on insertion and removal of the currency cassette 10 from a currency dispenser.

Figure 4B:
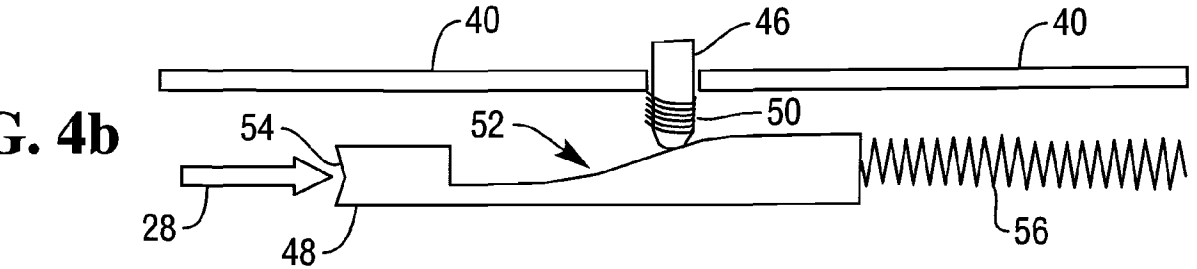
Figure 4C:
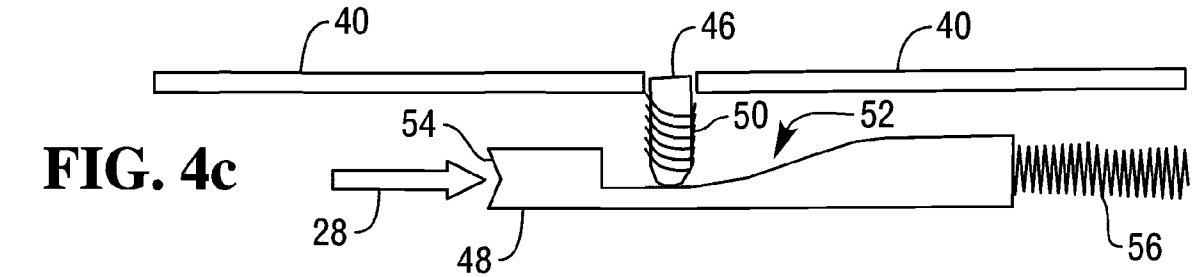

The detent 46 and detent moving mechanism 48 are best illustrated in FIGS. 4*a* to 4*c*, which illustrate the detent 46 and the detent moving mechanism 48 in three different positions. The detent 46 comprises a metal stub extending through a detent aperture (not shown) in the floor 40 and urged downwards by a coil spring 50 surrounding the metal stub. The detent moving mechanism 48 defines an arcuate cam surface 52 that engages with a lower surface of the detent 46, and a tine-engaging surface 54 for receiving a front end of a tine 28 as it enters one of the channels 30. A resilient member 56, in the form of a coil spring, is coupled between the non-picking end 20 and the detent moving mechanism 48 to urge the detent moving mechanism 48 towards the picking end 24.

Figure 5:
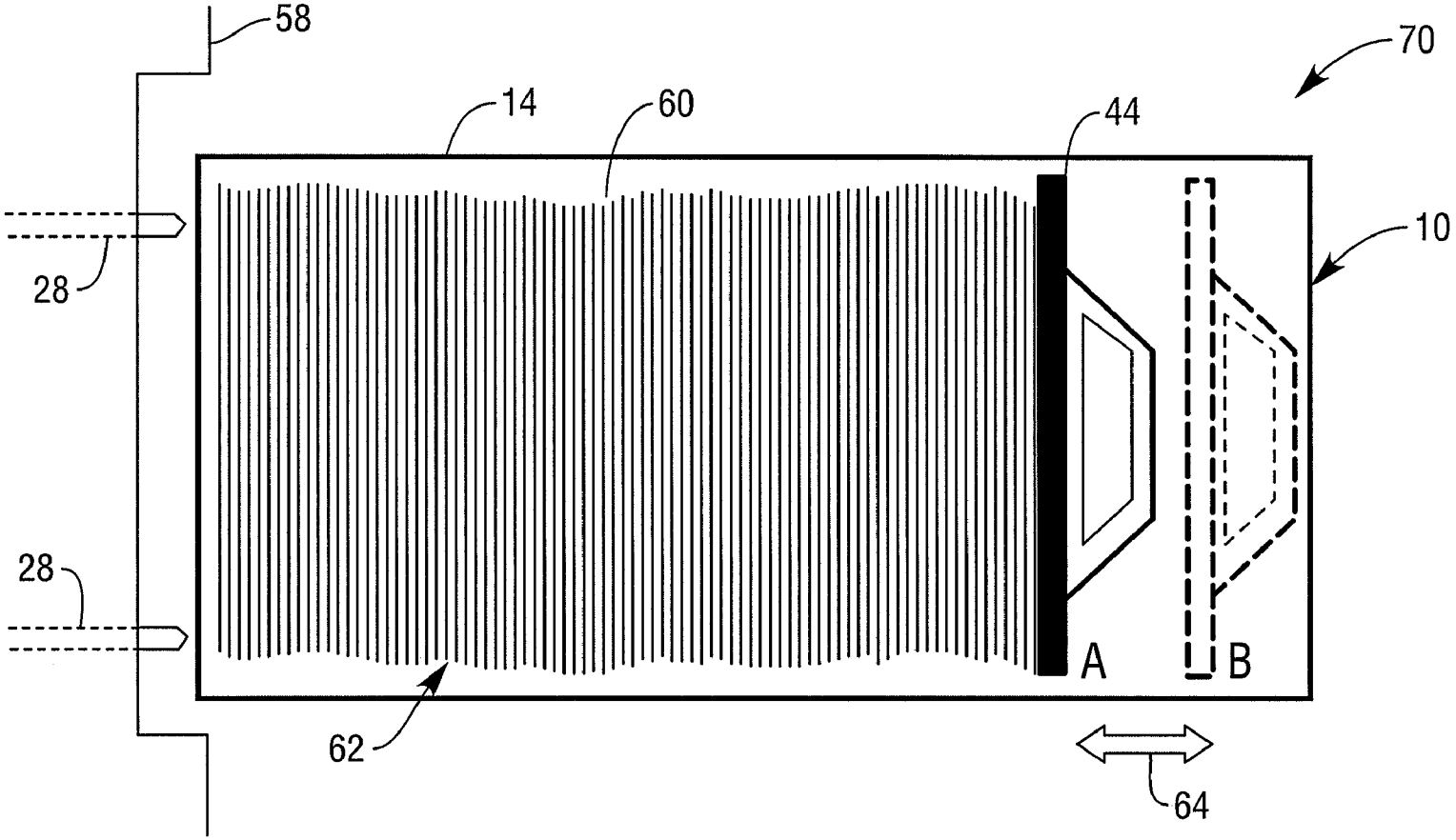
FIG. 5 is an ATM including a plan view of the body portion of the currency cassette of FIG. 2 being inserted into a media dispenser within the ATM, illustrating the detent mechanism in two positions.

When the currency cassette 10 is not mounted in a currency dispenser, then the detent moving mechanism 48 is urged by spring 56 to the position shown in FIG. 4*a*, which moves the detent 46 to a closed position. In this closed position, the detent 46 is urged upwards through the floor 40 by the arcuate cam surface 52, thereby preventing the urging plate 44 from moving closer to the non-picking end 20 than the detent location. This is illustrated in FIG. 5, which is a plan view of a full currency cassette being mounted in a currency dispenser 58. The closed position of FIG. 4*a* corresponds to position "A" in FIG. 5.

When the cassette 10 is to be filled with currency, then an operator (whether machine or human) removes the lid 12 and retracts the urging plate 44 until the urging plate 44 abuts the detent 46. The urging plate 44 cannot be retracted any further because the detent 46 prevents the urging plate 44 from moving any closer to the non-picking end 20. The urging plate 44, the floor 40, and the picking end 24 define a media zone 60 which can be filled with a stack 62 of media items, in this embodiment, the media items are banknotes. The stack 62 is oriented horizontally, with the long edges of the banknotes resting on the floor 40. The operator then replaces the lid 12.

When the currency cassette 10 is mounted in a currency dispenser 58, then the detent moving mechanism 48 is urged by the tine 28 through a partially open position shown in FIG. 4*b* to an open position shown in FIG. 4*c*. The open position of FIG. 4*c* corresponds to position "B" in FIG. 5.

When the detent 46 is in the open position, the urging plate 44 may be located closer to the non-picking end 20 than when the detent 46 is in the closed position because the detent 46 has been moved beneath the floor 40, thereby allowing the urging plate 44 to move towards the non-picking end 20 if forced backwards by the stack 62 of banknotes. This can occur if the currency zone 60 was overfilled with banknotes when the cassette 10 was filled by the operator. By allowing the urging plate 44 to move backwards, the size of the currency zone 60 is increased (as shown by arrow 64 in FIG. 5), which means that less force is applied to a banknote located at the pick window 22. This allows the currency dispenser 58 to execute a more reliable pick operation, thereby reducing the number of failed pick operations.

When the currency cassette 10 is removed from the currency dispenser 58, then the detent moving mechanism 48 is urged by spring 56 back to the position shown in FIG. 4*a* so that the detent 46 is in the closed position.

Various modifications may be made to the above described embodiment within the scope of the invention, for example, in other embodiments the detent 46 may be located entirely beneath the floor 40 and may abut a surface of the urging plate 44 beneath the floor 40.

In other embodiments, media items other than banknotes may be used, for example, tickets, passes, stamps, or the like.

In other embodiments, the detent moving mechanism may be implemented by a solenoid. The solenoid may be triggered by a signal received from a media handler, such as a currency cassette. The signal may be transmitted wirelessly or by physical contact, or in any other convenient manner. The signal may be transmitted by radio-frequency, a magnetic field, or in any convenient manner.

In other embodiments, the detent moving mechanism may move the detent horizontally rather than vertically. For example, the detent may be moveable parallel to the central rail.

In other embodiments, a plurality of detents may be provided transverse to the central rail, and the detent moving mechanism may be activated by two tines, one at each side of the cassette. This allows both conventional tines on an automated teller machine currency dispenser to be used to move the (or multiple) detent moving mechanism(s).

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

What is claimed is:

1. A media cassette comprising:

a housing defining a closeable pick window;

an urging plate biased towards the pick window for urging a stack of media items towards the pick window;

a detent located distal from the pick window for limiting movement of the urging plate away from the pick window when the pick window is closed; and a detent moving mechanism operable to move the detent when the pick window is opened, thereby allowing the urging plate to move away from the pick window to increase space occupied by the stack of media items and to exert less force on the stack of media items;

wherein the urging plate is slideably mounted on a floor spaced from a lower side of the housing, and coupled to a central rail located beneath the floor; and wherein the detent comprises a member protruding above the floor and moveable from a first position to a second position.

2. A media cassette according to claim 1, wherein the urging plate, the floor, and a pick window end of the cassette cooperate to define a media zone in which a stack of media items are placed so that the media zone is enlarged when the detent moving mechanism moves the detent from a first position to a second position.

3. A media cassette according to claim 1, wherein the detent comprises a resiliently-biased stub protruding through a detent aperture in the floor.

4. A media cassette according to claim 3, wherein the detent moving mechanism comprises a cam member resiliently coupled to an end of the housing, and including a cam surface, the cam member being moveable from (i) an inactive position in which the cam surface causes the resiliently-biased stub to protrude through the detent aperture and above the floor thereby stopping the urging plate from moving beyond the detent to an end opposite the pick window, to (ii) an active position in which the cam surface allows the resiliently-biased stub to extend beneath the floor thereby allowing the urging plate to move beyond the location of the detent to an end opposite the pick window.

5. A media cassette according to claim 4, wherein the cam member is moved from the inactive position to the active position by tines located within a currency dispenser in an ATM, where the tines also open the pick window as the cassette is inserted into the currency dispenser.

6. A method of presenting media within a media cassette having a pick window defined by one end of the cassette and a non-picking end opposite the pick window, the method comprising:

urging a stack of media items towards the pick window by an urging plate biased towards the pick window;

moving a detent moving mechanism having an arcuate cam surface in a first direction away from the pick window;

moving a detent by the detent moving mechanism from (i) a first position on the arcuate cam surface when the pick window is closed, the first position causing the detent to engage the urging plate distal from the pick window limiting movement of the urging plate away from the pick window, to (ii) a second position on the arcuate cam surface when the window is opened, the second position causing the detent to move in a second direction substantially perpendicular to the first direction and to disengage from the urging plate allowing the urging plate to move further from the pick window than when the detent is in the first position;

thereby allowing more space for the stack of media items between the pick window and the urging plate and causing the urging plate to exert less force against the stack of media items.

7. A self-service terminal comprising:

a dispenser including a pick unit engaged with a media cassette including a housing defining a closeable pick window;

an urging plate biased towards the pick window for urging a stack of media items towards the pick window;

a detent moveable through an aperture in a floor between a first position in which the detent engages a lower part of the urging plate to limit movement of the urging plate away from the pick window, and a second position in which the detent is recessed through the aperture allowing the urging plate to move away from the pick window to increase space occupied by the stack of media items and to exert less force on the stack of media items; and a detent moving mechanism operable to move the detent from the first position to the second position.

8. A self-service terminal according to claim 7, wherein the pick unit includes a plurality of tines for engaging with the media cassette to open the pick window and to move the detent from the first position to the second position.

9. A self-service terminal according to claim 7, wherein the self-service terminal comprises an automated teller machine.

10. A self-service terminal comprising a dispenser including a pick unit engaged with a media cassette, wherein the media cassette includes a housing defining a closeable pick window;

an urging plate biased towards the pick window for urging a stack of media items towards the pick window;

a detent located distal from the pick window for limiting movement of the urging plate away from the pick window when the pick window is closed; and a detent moving mechanism operable to move the detent when the pick window is opened, thereby allowing the urging plate to exert less force on the stack of media items;

wherein the urging plate is slideably mounted on a floor spaced from a lower side of the housing, and coupled to a central rail located beneath the floor;

wherein the detent comprises a member protruding above the floor and moveable from a first position to a second position; and wherein the pick unit includes a plurality of tines for engaging the media cassette to open the pick window and to move the detent from the first position to the second position.

11. A media cassette comprising:

a housing defining a closeable pick window;

an urging plate biased towards the pick window for urging a stack of media items towards the pick window;

a detent including a member located beneath a floor for engaging a lower part of the urging plate; and a detent moving mechanism having an arcuate cam surface and moveable in a first direction;

wherein the detent is moveable between a first position on the arcuate cam surface for causing the detent to engage the urging plate distal from the pick window limiting movement of the urging plate away from the pick window when the pick window is closed and a second position on the arcuate cam surface when the pick window is opened for causing the detent to move in a second direction substantially perpendicular to the first direction and to disengage from the urging plate allowing the urging plate to move further from the pick window than when the detent is in the first position to increase space occupied by the stack of media items and to exert less force on the stack of media items.

12. A media cassette comprising:

an urging plate having first and second sides, wherein the first side is biased in a first direction against a stack of media in the media cassette;

a detent moveable through an aperture in a floor between a first position in which the detent engages a lower part of the urging plate to limit movement of the urging plate away from the stack of media, and a second position in which the detent is recessed through the aperture allowing the urging plate to move away from the stack of media to increase space occupied by the stack of media items and to exert less force on the stack of media items; and a detent moving mechanism operable to move the detent from the first position to the second position.

* * * * *